United States Patent [19]

Anbe

[11] 4,236,216

[45] Nov. 25, 1980

[54] CONTROL SYSTEM OF INTERSTAND TENSION OF CONTINUOUS ROLLING MILLS

[75] Inventor: Yoshiharu Anbe, Fuchu, Japan

[73] Assignee: Tokyo Shibaura Denki Kabushiki Kaisha, Kanagawa, Japan

[21] Appl. No.: 34,198

[22] Filed: Apr. 27, 1979

Related U.S. Application Data

[63] Continuation-in-part of Ser. No. 893,403, Apr. 4, 1978, abandoned.

[30] Foreign Application Priority Data

Apr. 28, 1977 [JP] Japan ..... 52/49622

[51] Int. Cl.[3] ..... G06F 15/46; B21B 37/00

[52] U.S. Cl. ..... 364/472; 72/8; 364/105

[58] Field of Search ..... 364/469, 472, 105; 72/8, 11, 12, 16, 19, 21

[56] References Cited

U.S. PATENT DOCUMENTS

| | | | |
|---|---|---|---|
| 3,507,134 | 4/1970 | Silva | 364/472 X |
| 3,531,961 | 10/1970 | Dunn | 364/472 X |
| 3,574,280 | 4/1971 | Smith, Jr. | 364/472 X |
| 3,592,031 | 7/1971 | Sutton et al. | 364/472 X |
| 4,011,743 | 3/1977 | Peterson et al. | 364/469 X |

FOREIGN PATENT DOCUMENTS

| | | | |
|---|---|---|---|
| 1280821 | 7/1972 | United Kingdom | 364/472 |

*Primary Examiner*—Joseph F. Ruggiero
*Attorney, Agent, or Firm*—Stevens, Davis, Miller & Mosher

[57] ABSTRACT

Voltage, current, speed, and acceleration of each stand driving motor are detected and the rolling force of each stand is also detected. A processor unit is provided to determine the torque and the rolling force of the stands under no tension condition as well as under interstand tension condition for determining the interstand tension, and to determine a speed correction signal which is applied to a speed setter of the mill driving motor.

14 Claims, 5 Drawing Figures

CONTROL SYSTEM OF INTERSTAND TENSION OF CONTINUOUS ROLLING MILLS

CROSS-REFERENCE TO RELATED APPLICATION

This application is a continuation-in-part of our prior Application Ser. No. 893403 filed Apr. 4, 1978, and now abandoned.

BACKGROUND OF THE INVENTION

This invention relates to a control system of the interstand tension of a continuous rolling mill, more particularly of the type comprising an edger mill and a horizontal mill (a universal mill in the case of rolling shape steels) such as a rougher rolling stand of a hot strip mill and a shape steel rolling mill.

The interstand tension of a continuous rolling mill, for example, a finishing mill of a hot strip is automatically controlled to the desired value by detecting the interstand tension by a looper, for example, and by using the detected interstand tension to control the driving motors of the mill. However, in the continuous mill such as the rougher rolling stand of a hot strip mill and a shape steel rolling mill as the gauge of the strip is large it is difficult to form a loop so that use of the looper is not possible. Accordingly, the operator of the mill controls the interstand tension by manually controlling the speed of the mill drive motors while observing the strip being rolled.

With this system, however, it has been impossible to provide an adequate control by the misoperation of the operator or lack of skill thereof.

SUMMARY OF THE INVENTION

It is an object of this invention to provide an improved interstand tension control system of a continuous mill capable of controlling the interstand tension to an optimum value without accompanying the problem described above.

According to this invention this and other objects can be accomplished by providing a control system of the interstand tension of a continuous rolling mill including a plurality of stands each provided with mill rolls driven by a motor with a speed regulator, characterized by comprising:

(a) one or more torque calculation devices each associated with each of the stands except the master stand and each adapted to calculate the torque of the associated stand, (b) one or more no tension torque calculation devices each associated with each of the stands except the master stand and the stand on the upstream side of all of the other stands except the master stand and each adapted to calculate the no tension torque of the associated stand, (c) one or more no tension torque memory devices each associated with each of the stands except the master stand, and each adapted to store the no tension torque of the associated stand, (d) one or more no tension torque memory devices each associated with each of the stands except the master stand and each adapted to store the no tension rolling force of the associated stand, (e) one or more target torque calculation devices each associated with each of the stands except the master stand and each adapted to calculate the target tension torque for the associated stand, (f) one or more speed correction calculation devices each associated with each of the stands except the master stand and each adapted to calculate the speed correction quantity for the motor of the associated stand, and (g) one or more controlling means each associated with each of the stands except the master stand, each of the controlling means responsive to a reference speed signal for the associated motor and the speed correction quantity from the associated speed correction calculation device for controlling the speed regulator of the driving motor of the associated stand.

DESCRIPTION OF THE PREFERRED EMBODIMENT

Figure 1:
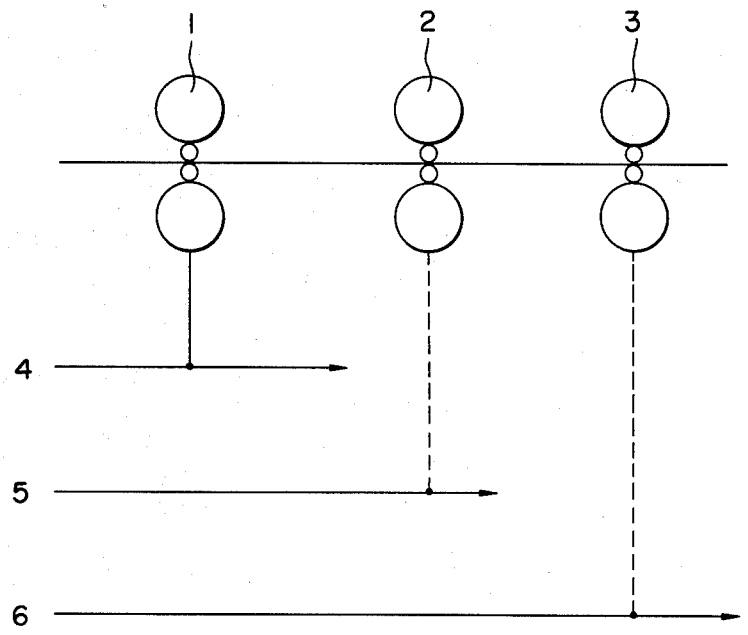
FIG. 1 is a diagram showing the principle of the control system of this invention.

FIG. 1 shows a continuous mill comprising three mill stands 1, 2 and 3. While a strip S is being rolled by the first stand 1 alone as shown by 4, the rolling force $P_{10}$ and the rolling torque $G_{10}$ of the first stand are detected and stored in memory devices as will be described later. At this time, the strip does not bridge two stands so that the strip tension is zero. When the strip is rolled by two stands as shown by 5, a tension is created between the first and second mill stands. Under these conditions, the rolling force $P_1$ and the rolling torque $G_1$ of the first stand are measured, and the speed of the motor for driving the first stand is corrected by $\Delta N_1$ expressed by the following equation to maintain the strip tension between the first and second stands at a target value of zero or a small constant value, either positive (tension) or negative (compression).

$$\Delta N_1 = g_1 \cdot \left(\frac{G_{10}}{P_{10}} \cdot P_1 - G_1 - G_{1t}\right) \qquad 1$$

where $g_1$ represents proportional, integrating and differentiating operations and $G_{1t}$ the torque of the first stand corresponding to the target tension. $G_{1t}=0$ means that the target tension is zero.

This control utilizes the result of experiment showing that the ratio $G_{10}/P_{10}$ is constant irrespective of the temperature and dimension of the strip. Then the rolling force $P_{20}$ and the rolling torque $G_{20}$ of the second stand under no tension condition are measured at a state 5 shown in FIG. 1. At this time, since there is a tension (or compression) between the first and second stands, the rolling force and the rolling torque of the first stand and the speeds of the driving motors of the first and second stands are measured. At the same time, the rolling force $P_2$ and the rolling torque $G_2$ of the second stand are also measured to obtain $P_{20}$ and $G_{20}$.

The rolling torque $G_{20}$ of the second stand under no tension is shown by $$G_{20} = G_2 - \frac{N_1}{N_2} \cdot \left(\frac{G_{10}}{P_{10}} \cdot P_1 - G_1\right) \quad 2$$

where $N_1$ and $N_2$ represent the speeds of the driving motors of the first and second stands respectively. The rolling force of the second stand under no tension can be expressed as follows by approximation $$P_{20} \approx P_2 \quad 3$$

Theoretically, $P_{20}$ is a difference between $P_2$ and the load caused by the tension but where the load variation due to the tension is small, equation 3 holds.

Where the strip is rolled by three successive stands as shown by 6 in FIG. 1, there are interstand tensions between adjacent stands.

The tension between the first and second stands is used to obtain the target tension expressed by equation 1, whereas the tension between the second and third stands corrects the speed of the second stand driving motor by $\Delta N_2$ expressed by the following equation 4 to obtain the target tension.

$$\Delta N_2 = g_2 \cdot \left[\frac{G_{20}}{P_{20}} \cdot P_2 - \left\{G_2 - \frac{N_1}{N_2} \cdot \left(\frac{G_{10}}{P_{10}} \cdot P_1 - G_1\right)\right\} - G_{2t}\right] \quad 4$$

where $g_2$ represents a calculation of (proportion+integration+differentiation), $G_{2t}$ the torque of the second stand corresponding to the target tension between the second and third stands. In order to prevent variation of the interstand tension between the first and second stands caused by the correction of the speed of the second stand driving motor by $\Delta N_2$, a successive quantity $$\Delta N_1' = \frac{N_1}{N_2} \cdot \Delta N_2 \quad 5$$

is applied to the first stand driving motor.

Figure 2:
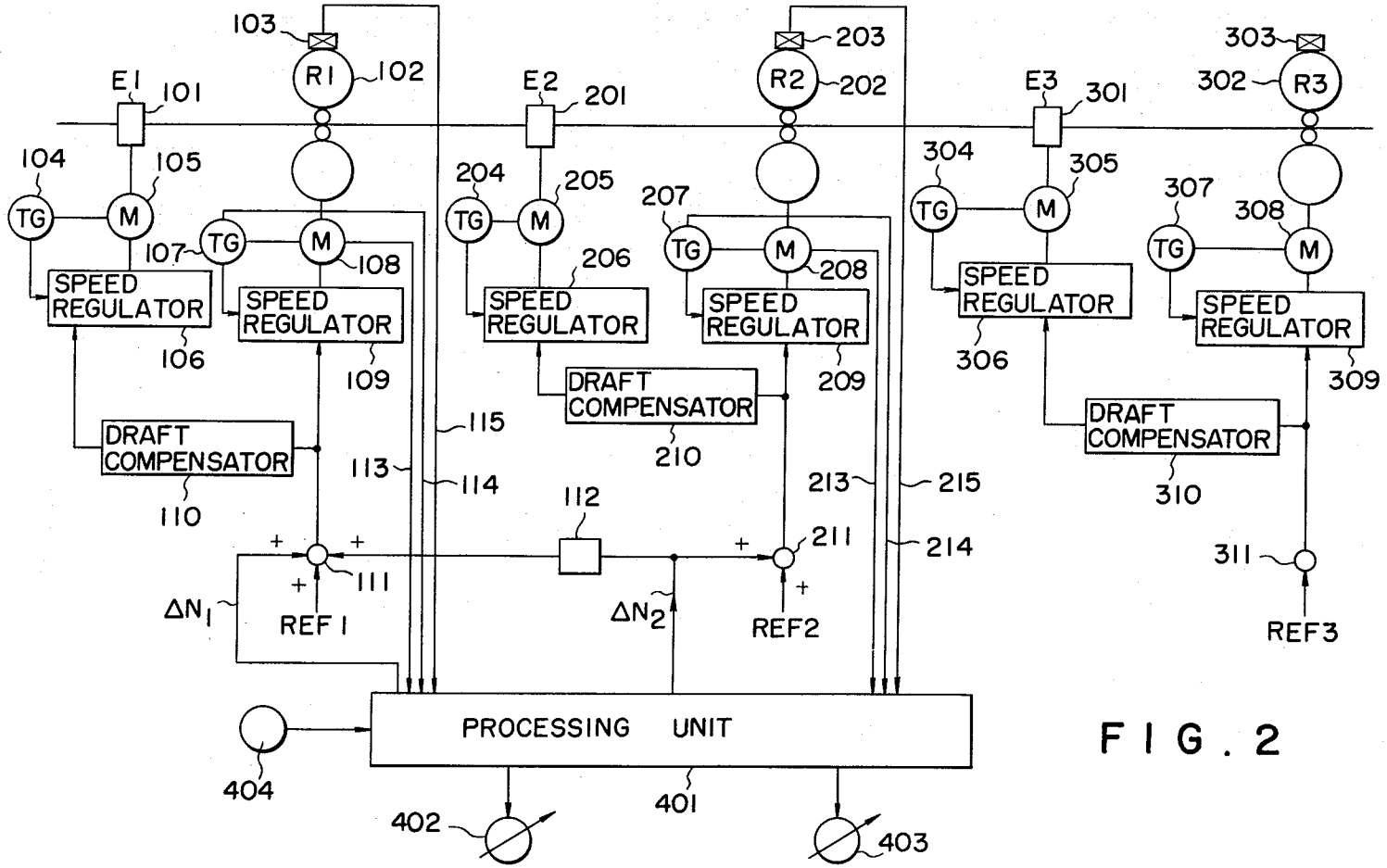
FIG. 2 is a block diagram showing a preferred embodiment of this invention.

FIG. 2 shows the control system of this invention as applied to rougher stands of a continuous hot strip mill comprising three stands as in FIG. 1. As shown, vertical roll mills (edger mills) 101, 201 and 301 are provided to roll the side edges and horizontal roll mills 102, 202 and 302 are provided to reduce the gauge of the strip. Respective mills are equipped with driving motors, 105, 205, 305, 108, 208 and 308, pilot or pulse generators 104, 107, 204, 207, 304 and 307, and speed regulators 106, 109, 206, 209, 306 and 309 for respective driving motors. Thus, for example, the speed of the driving motor 108 of the first stand 102 is detected by pilot generator 107 and controlled by the speed regulator 109.

Respective edger mills 101, 201 and 301 of respective stands are provided with draft compensators 110, 210 and 310 for decreasing the speeds of the edger mills by an amount corresponding to the reduction provided by the horizontal rolls. The horizontal rolls 102, 202 and 302 of respective stands are provided with means 103, 203 and 303, for example load cells, for detecting the rolling forces. Voltage and current of motors 108 and 208, speed and acceleration thereof detected by pilot generators 107 and 207 and signals detected by load cells 103 and 203 are applied to a processing unit 401 of the computer, the detail of which will be described later. The processing unit 401 is provided with a setter 404 for setting the gauge, the width and the speed of the strip, and a target value of the interstand tension, and tension meters 402 and 403 for indicating the calculated values of the interstand tension, thus performing various arithmetic operations as will be described later.

Speed set signals or reference speed signals $REF_1$ through $REF_3$ are applied to respective motors 108, 208 and 308 through adders 111, 211 and 311 respectively. Speed correction signal $\Delta N_1$ and $\Delta N_2$ are calculated in the processing unit 401 as will be described later and are applied to the adders 111 and 211 respectively. The speed correction signal $\Delta N_2$ is also applied to a successive operator 112, which also receives the speed $N_1$ and the speed $N_2$ and performs the operation of the equation 5 to determine the successive quantity $\Delta N_1'$. The successive quantity $\Delta N_1'$ is added at the adder 111 to $REF_1$ and $\Delta N_1$.

Since the third stand is a pilot stand and its speed is not varied it is not connected to the processing unit 401.

Figure 3A:
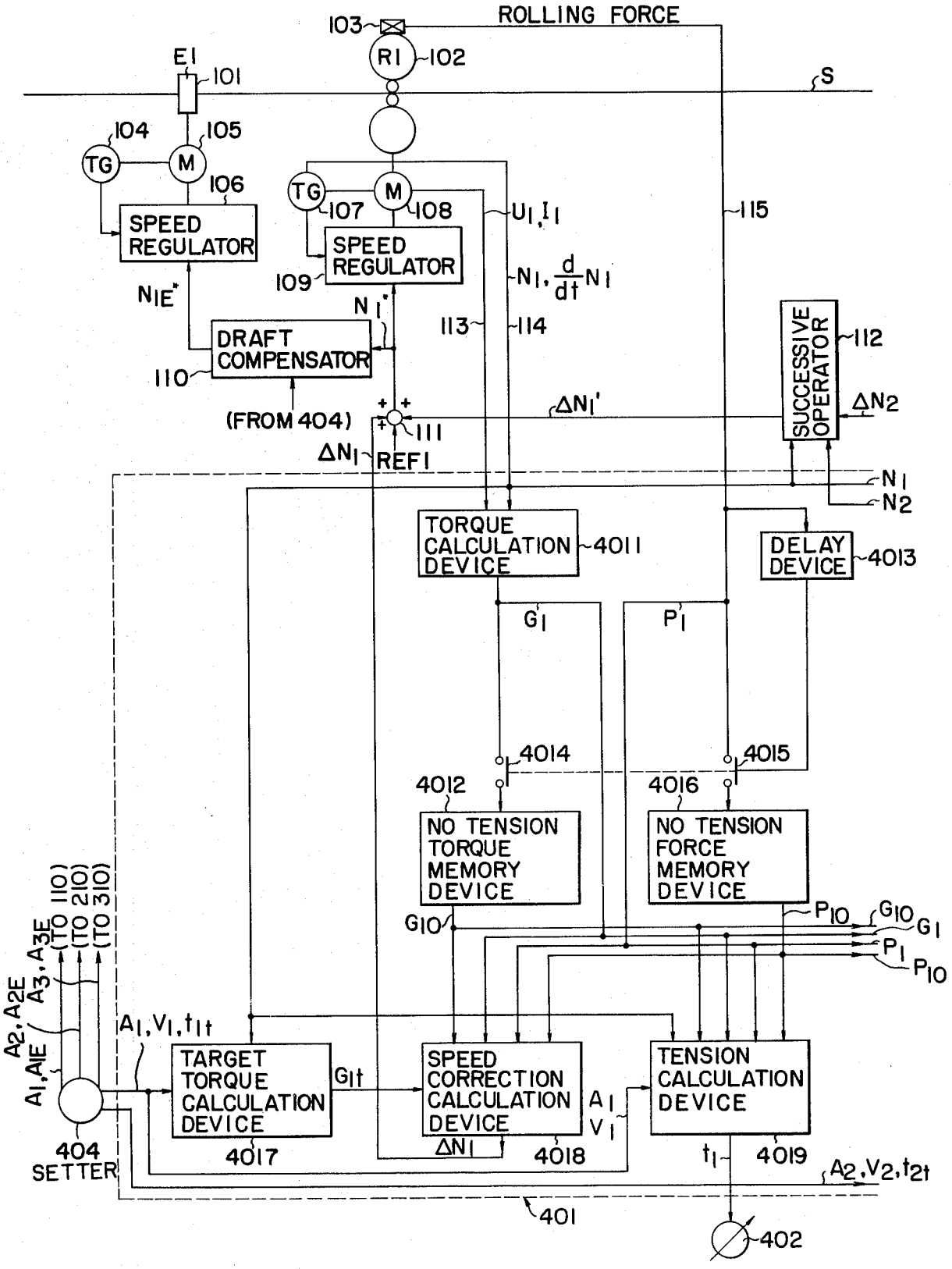
FIGS. 3A, 3B and 3C are block diagrams showing the detail of the processing unit of FIG. 2.
Figure 3B:
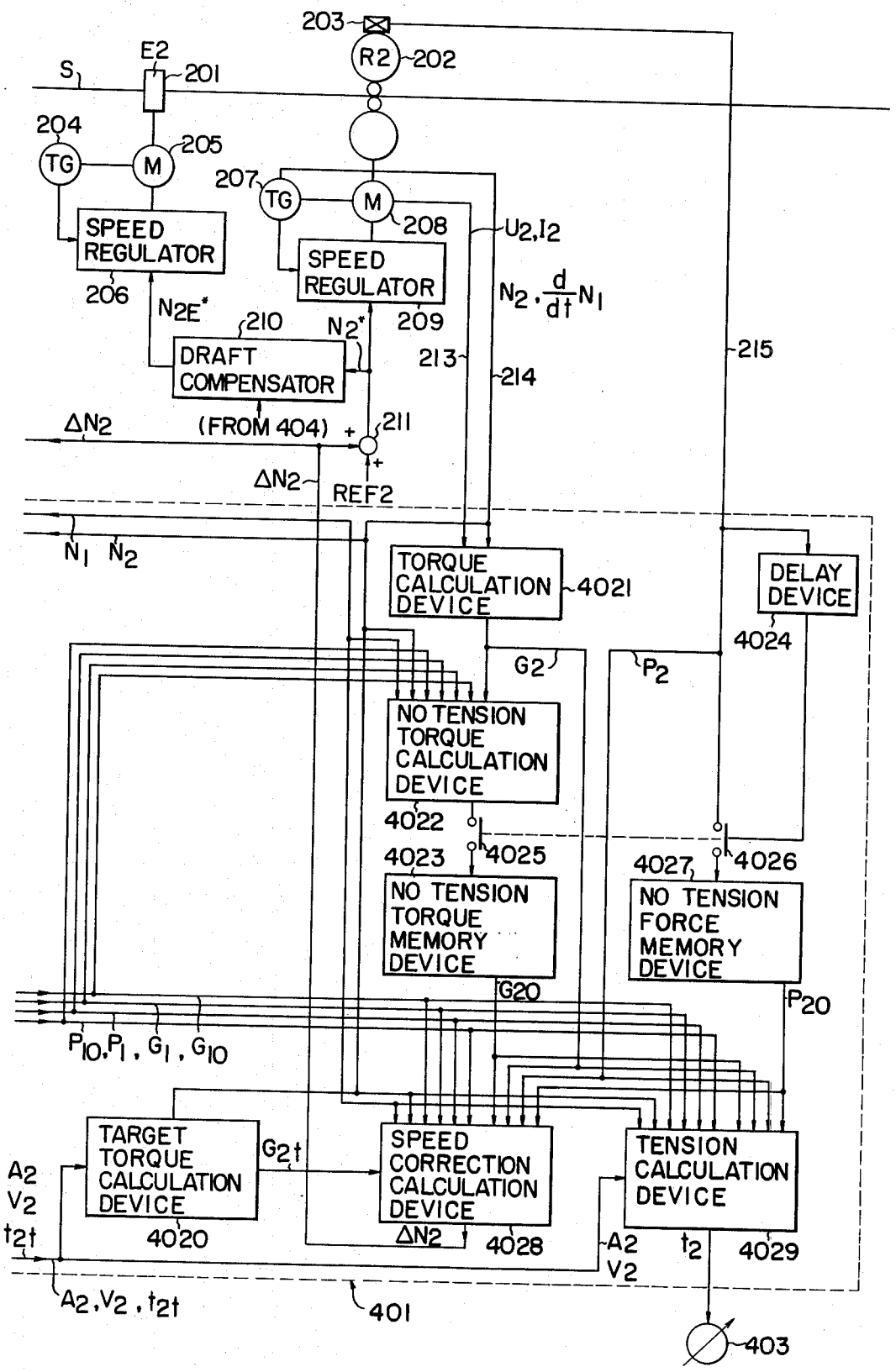
Figure 3C:
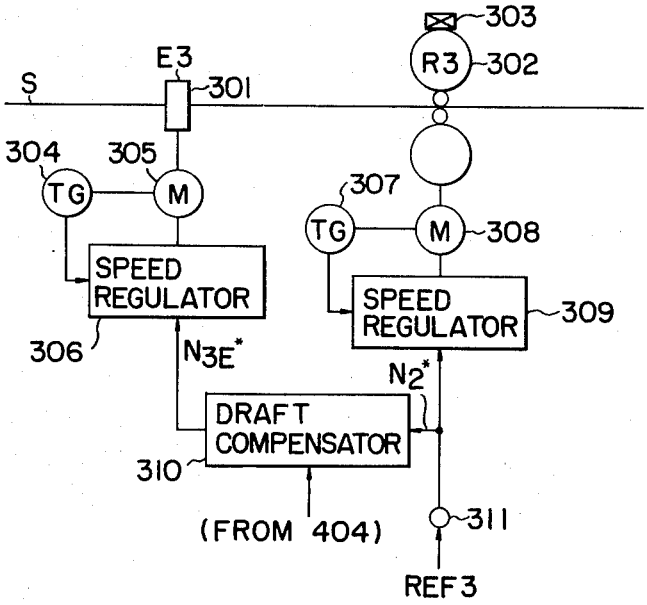

FIGS. 3A, 3B and 3C, when combined, show the detail of the processing unit 401.

Denoted by numeral 4011 is a torque calculation device which receives the voltage $U_1$ and the current $I_1$ of the motor 108 via the line 113 as well as the speed $N_1$ and the acceleration ($dN_1/dt$) of the motor 108 via the line 114, and performs the operation of the following equation to determine the torque $G_1$.

$$G_1 = k_1 \cdot \frac{U_1 - I_1 R}{N_1} \cdot I_1 - k_2 \frac{dN_1}{dt} - (k_3 N_1 + k_4) \quad 6$$

where $U_1$, $I_1$, R and $N_1$ respectively represent the voltage, the current, the armature resistance and the speed of the motor 108, and $k_1$, $k_2$, $K_3$ and $k_4$ constants.

A delay device 4013 detects the entry of the strip into the first stand $R_1$ by sending the variation of the rolling force caused by such entry, and, after expiration of a predetermined delay time closes relay contacts 4014 and 4015 and maintains them closed for a certain period.

When the relay contact 4014 is closed a no tension torque memory device 4012 receives the torque $G_1$ and stores it as a torque under no tension condition or a no tension torque $G_{10}$.

When the relay contact 4015 is closed a no tension force memory device 4016 receives the rolling force $P_1$ and stores it as a rolling force under no tension condition or a no tension rolling force $P_{10}$.

A target torque calculation device 4017 receives the speed of the motor 108 as well as the cross sectional area $A_1$, the speed $V_1$, and the target tension $t_{1t}$ of the strip on the exit side of the stand $R_1$ which are supplied from the setter 404, and performs the operation of the following equation to determine the target tension torque $G_{1t}$ between the first and the second stands.

$$G_{1t} = \frac{k_{1t}}{N_1} \cdot A_1 \cdot V_1 \cdot t_{1t} \quad 7$$

where $k_{1t}$ represents a constant.

A speed correction calculation device 4018 receives the no tension torque $G_{10}$ stored in the memory device 4012, the no tension rolling force $P_{10}$ stored in the memory device 4016, the torque $G_1$ from the torque calculation device 4011 and the rolling force $P_1$ from the load cell 103, as well as the target torque $G_{1t}$ from the target torque calculation device 4017, and performs the operation of the equation 1 to determine the speed correction quantity $\Delta N_1$, which is applied to the adder 111.

A tension calculation devide 4019 receives the no tension torque $G_{10}$, the no tension force $P_{10}$, the torque $G_1$, the rolling force $P_1$ and the speed $N_1$ of the motor 108 as well as the cross sectional area $A_1$ and the speed $V_1$ of the strip, and performs the operation of the following equation to determine the interstand tension $t_1$ between the first and the second stands.

$$t_1 = \frac{N_1}{k_{1t} \cdot A_1 \cdot V_1} \cdot \left(\frac{G_{10}}{P_{10}} \cdot P_1 - G_1\right) \quad 8$$

The interstand tension $t_1$ thus calculated is sent to the tension meter 402 for display.

A torque calculation device 4021 receives the voltage $U_2$ and the current $I_2$ of the motor 208 via the line 213 and the speed $N_2$ and the acceleration ($dN_2/dt$) of the motor 208 via the line 214 and performs the operation of an equation identical to the equation 6 except that $G_1$, $U_1$, $I_1$, $R_1$ and $N_1$ are replaced by $G_2$, $U_2$, $I_2$, $R_2$ and $N_2$ respectively, to determine the torque $G_2$.

A no tension torque calculation device 4022 receives the no tension torque $G_{10}$, the no tension rolling force $P_{10}$, the torque $G_1$ and the speed $N_1$ as well as the torque $G_2$ and the speed $N_2$, and performs the operation of the equation 2 to determine the no tension torque $G_{20}$.

A delay device 4024 detects the entry of the strip into the second stand $R_2$ by sensing the variation of the rolling force, and after expiration of a predetermined delay time closes relay contacts 4025 and 4026.

When the relay contact 4025 is closed, a no tension torque memory device 4023 receives the no tension torque $G_{20}$ from the no tension torque calculation device 4022 and stores it.

When the relay contact 4026 is closed a no tension force memory device 4027 receives the rolling force $P_2$ and stores it as the no tension rolling force $P_{20}$.

A target torque calculation device 4020 receives the speed $N_2$ as well as the cross sectional area $A_2$, the speed $V_2$ and the target tension stress $t_{2t}$ of the strip on the exit side of the stand $R_2$ which are supplied from the setter 404, and performs the operation of the following equation to determine the target torque $G_{2t}$.

$$G_{2t} = \frac{k_{2t}}{N_2} \cdot A_2 \cdot V_2 \cdot t_{2t} \quad 9$$

where $k_{2t}$ represents a constant.

A speed correction calculation device 4028 receives the no tension torque $G_{10}$, the no tension rolling force $P_{10}$, the torque $G_1$, the rolling force $P_1$ and the speed $N_1$ as well as the no tension torque $G_{20}$, the no tension rolling force $P_{20}$, the torque $G_2$, the rolling force $P_2$ and the speed $N_2$, and performs the operation of the equation 4 to determine the speed correction quantity $\Delta N_2$.

A tension calculation device 4029 receives the no tension torque $G_{20}$, the no tension rolling force $P_{20}$, the torque $G_2$, the rolling force $P_2$, the speed $N_2$, the cross sectional area $A_2$ and the speed $V_2$ as well as the no tension torque $G_{10}$, the no tension rolling force $P_{10}$, the torque $G_1$ and the rolling force $P_1$, and performs the operation of the following equation to determine the interstand tension $t_2$ between the second and third stands.

$$t_2 = \quad 10$$

-continued $$\frac{N_2}{k_{2t} \cdot A_2 \cdot V_2} \cdot \left[\frac{G_{20}}{P_{20}} \cdot P_2 - \left\{G_2 - \frac{N_1}{N_2} \cdot \left(\frac{G_{10}}{P_{10}} \cdot P_1 - G_1\right)\right\}\right]$$

The tension thus calculated is sent to the tension meter 403 for display.

A draft compensator 110 receives the target speed $N_1^*$ which is the output of the adder 111, and performs the operation of the following equation to determine a compensated target speed $N_{1E}^*$ for the motor 105 of the edger mill $E_1$ $$N_{1E}^* = \frac{A_1}{A_{1E}} \cdot N_1^* \quad 11$$

where $A_{1E}$ represents the cross sectional area of the strip on the exit side of the edger mill $E_1$ and is given by the setter 404.

Similar draft compensators 210 and 310 are provided for the edger mills $E_2$ and $E_3$.

Assume now that respective mills are operating under speed instructions $REF_1$, $REF_2$ and $REF_3$ respectively. Under these conditions, the speed correction quantities $\Delta N_1$ and $\Delta N_2$ of the first and second stands are zero. While the strip is rolled by the first stand, no tension torque $G_{10}$ and the no rolling force $P_{10}$ are stored in the memories 4012 and 4015 respectively.

When the leading end of the strip enters into the second stand, the rolling torque $G_1$ and the rolling force $P_1$ as well as the no tension torque $G_{10}$ and the no tension rolling force $P_{10}$ are utilized to calculate the speed correction quantity $\Delta N_1$. The speed correction quantity $\Delta N_1$ thus obtained is added to the speed instruction $REF_1$.

At the same time, the interstand tension $t_1$ between the first and the second stands is calculated by the device 4019 and is displayed by the meter 402.

The value of the speed correction quantity $\Delta N_1$ is optimum when a target tension torque (expressed by the equation 7) is determined such that the interstand tension becomes a desired value.

Before the leading end of the strip reaches the third stand, the no tension torque $G_{20}$ and the no tension rolling force $P_{20}$ are stored in the memory devices 4023 and 4027 respectively.

As the leading end of the strip reaches the third stand, the second stand speed correction quantity $\Delta N_2$ is calculated, and is added to the speed instruction $REF_2$.

The successive quantity $\Delta N_1'$ is calculated by the successive operator 112 and is also added to $REF_1$ and $\Delta N_1$.

The interstand tension stress $t_2$ between the second and third stands is calculated by the device 4029 and is displayed by the meter 403.

Although, the invention was described as applied to a 3 stand system, even when the number of the stands increases, similar calculations are performed to attain the object of this invention.

Although in the foregoing embodiment, the speed of the driving motor of the stand on the upstream side was controlled it is possible to use the first stand as the master stand to maintain the speed thereof at a constant value thereby controlling the speed of the stand on the downstream side.

As the edger mill is draft compensated for with respect to the horizontal mill associated therewith, it is possible to provide similar tension control by adding a load cell to the edger mill for measuring the rolling torque thereof. In this case, the edger mill is handled as an independent stand.

At the time of changing the lot or the gauge of the finished product, tension control is performed for the first strip of the new lot, the speed ratios of respective stands are stored in memory devices, not shown, for use to the next strip. This process is repeated for the second and the following strips until an initial speed setting assuring stable target tension can be reached.

The calculation of the speed correction quantity is made at each sampling pitch may be variable. Furthermore, the tension stress meter may indicate the total tension.

According to this invention there is provided an improved mill control system capable of automatically controlling the interstand tension of a continuous mill to be always at an optimum value thereby producing high quality products.

What is claimed is:

1. In a control system of the interstand tension of a continuous rolling mill including a plurality of stands each provided with mill rolls driven by a motor with a speed regulator, the improvement which comprises:

(a) one or more torque calculation devices each associated with each of the stands except the master stand and each adapted to calculate the torque of the associated stand, (b) one or more no tension torque calculation devices each associated with each of the stands except the master stand and the stand on the upstream side of all of the other stands except the master stand and each adapted to calculate the no tension torque of the associated stand, (c) one or more no tension torque memory devices each associated with each of the stands except the master stand, and each adapted to store the no tension torque of the associated stand, (d) one or more no tension force memory devices each associated with each of the stands except the master stand and each adapted to store the no tension rolling force of the associated stand, (e) one or more target torque calculation devices each associated with each of the stands except the master stand and each adapted to calculate the target tension torque for the associated stand, (f) one or more speed correction calculation devices each associated with each of the stands except the master stand and each adapted to calculate the speed correction quantity for the motor of the associated stand, and (g) one or more controlling means each associated with each of the stands except the master stand, each of the controlling means responsive to a reference speed signal for the motor of the associated stand and the speed correction quantity from the associated speed correction calculation device for controlling the speed regulator of the driving motor of the associated stand.

2. A control system as set forth in claim 1 further comprising:

first detection systems each associated with each of the stands except the master stand and each adapted to detect the voltage and the current of the motor of the associated stand, second detection systems each associated with each of the stands except the master stand and each adapted to detect the speed and the acceleration of the motor of the associated stand, and third detection systems each associated with each of the stands except the master stand and each adapted to detect the rolling force of the associated stand.

3. A control system as set forth in claim 1 further comprising a speed setting system for providing the reference speed signals for the motors of the stands.

4. A control system as set forth in claim 1 wherein each of the torque calculation devices is adapted to perform operation expressed by the following equation:

$$G_n = k_1 \cdot \frac{U_n - I_n R_n}{N_n} \cdot I_n - k_2 \cdot \frac{dN_n}{dt} - (k_3 N_n + k_4)$$

where $G_n$: the toruqe $U_n$: the voltage of the motor $I_n$: the current of the motor $R_n$: the armature resistance of the motor $N_n$: the speed of the motor $k_1$, $k_2$, $k_3$, $k_4$: constants.

5. A control system as set forth in claim 1 wherein each of the no tension torque calculation devices is adapted to perform operation expressed by the following equation:

$$G_{no} = G_n - \frac{N_{n-1}}{N_n} \cdot \left(\frac{G_{(n-1)o}}{P_{(n-1)o}} \cdot P_{n-1} - G_{n-1}\right)$$

where $G_{no}$: the no tension torque of the associated stand $G_n$: the torque of the associated stand $N_n$: the speed of the motor of the associated stand $G_{(n-1)o}$: the no tension torque of the stand on the upstream side of the associated stand $G_{n-1}$: the torque of the stand on the upstream side of the associated stand $P_{(n-1)o}$: the no tension rolling force of the stand on the upstream side of the associated stand $P_{n-1}$: the rolling force of the stand on the upstream side of the associated stand $N_{n-1}$: the speed of the motor of the stand on the upstream side of the associated stand.

6. A control system as set forth in claim 5 wherein each of the no tension torque memory devices except that associated with the stand on the upstream side of all of the other stands except the master stand is adapted to store the no tension torque calculated by the associated no tension torque calculation device when the leading end of the strip has passed the associated stand and has not reached the next stand, and the no tension torque memory associated with the stand on the upstream side of all of the other stands except the master stand is adapted to receive the torque calculated by the associated torque calculated device when the leading end of the strip has passed the associated stand and has not reached the next stand and to store the thus received torque as the no tension torque.

7. A control system as set forth in claim 1 wherein each of the no tension rolling force memory devices is adapted to receive the rolling force when the leading end of the strip has passed the associated stand and has not reached the next stand and to store the thus received rolling force as the no tension rolling force.

8. A control system as set forth in claim 1 wherein each of the target torque calculation devices is adapted to perform operation expressed by the following equation:

$$G_{nt} = \frac{k_{nt}}{N_n} \cdot A_n \cdot V_n \cdot t_{nt}$$

where $G_{nt}$: the target tension torque
$N_n$: the speed of the motor
$A_n$: the cross sectional area of the strip on the exit side of the associated stand
$V_n$: the speed of the strip on the exit side of the associated stand
$t_{nt}$: the target tension of the strip on the exit side of the associated stand
$k_{nt}$: a constant.

9. A control system as set forth in claim 1 wherein each of the speed correction calculation devices except that associated with the stand on the upstream side of all of the other stands except the master stand is adapted to perform operation expressed by the following equation:

$$\Delta N_n = g_2 \cdot \left[ \frac{G_{no}}{P_{no}} \cdot P_n - \left\{ G_n - \frac{N_{n-1}}{N_n} \cdot \left( \frac{G_{(n-1)o}}{P_{(n-1)o}} \cdot P_{n-1} - G_{n-1} \right) \right\} - G_{nt} \right]$$

where $g_2$ represents a calculation of (proportion+integration+differentiation), and
$\Delta N_n$: the speed correction quantity
$G_{no}$: the no tension torque of the associated stand
$P_{no}$: the no tension rolling force of the associated stand
$G_n$: the torque of the associated stand
$P_n$: the rolling force of the associated stand
$G_{nt}$: the torque of the associated stand corresponding to the target tension between the associated stand and the next stand
$G_{(n-1)o}$: the no tension torque of the stand on the upstream side of the associated stand
$P_{(n-1)o}$: the no tension rolling force of the stand on the upstream side of the associated stand
$G_{n-1}$: the torque of the stand on the upstream side of the associated stand
$P_{n-1}$: the rolling force of the stand on the upstream side of the associated stand, and the speed correction device associated with the stand on the upstream side of all of the other stands except the master stand is adapted to perform operation expressed by the following equation:

$$\Delta N_1 = g_1 \cdot \left( \frac{G_{10}}{P_{10}} \cdot P_1 - G_1 - G_{1t} \right)$$

where $g_1$ represents a calculation of (proportion+integration+differentiation), and
$\Delta N_1$: the speed correction quantity
$G_{10}$: the no tension torque
$P_{10}$: the no tension rolling force
$G_1$: the torque
$P_1$: the rolling force
$G_{1t}$: the torque corresponding to the target tension.

10. A control system as set forth in claim 1 further comprising:

one or more successive operators each associated with each of the stands except the master stand and the stand on the downstream side of all of the other stands except the master stand and each adapted to perform operation expressed by the following equation:

$$\Delta N_n' = \frac{N_n}{N_{n+1}} \cdot \Delta N_{n+1}$$

where $\Delta N_n'$: the successive quantity
$N_n$: the speed of the motor of the associated stand
$N_{n+1}$: the speed of the motor of the stand on the downstream side of the associated stand
$\Delta N_{n+1}$: the speed correction quantity for the motor of the stand on the downstream side of the associated stand, to determine the successive quantity, and where each of said controlling means except that associated with each of the stand on the downstream side of all of the other stands except the master stand comprises an adder for adding the reference speed, the speed correction quantity and the successive quantity to determine the target speed to be supplied to the associated speed regulator, and the controlling means associated with the stand on the downstream of all of the stands except the master stand comprises an adder for adding the reference speed and the speed correction quantity to determine the target speed to be supplied to the associated speed regulator.

11. A control system as set forth in claim 1 wherein each stand comprises a horizontal mill.

12. A control system as set forth in claim 1 further comprising means for setting the cross sectional areas and the speeds of the strip and target values of the interstand tension.

13. A control system as set forth in claim 1 wherein each stand comprises an edger mill driven by a first motor, and a horizontal mill driven by a second motor.

14. In a control system of the interstand tension of a continuous rolling mill including a plurality of stands each provided with mill rolls driven by a motor, the improvement which comprises:

(a) one or more torque calculation devices each associated with each of the stands except the master stand and each adapted to perform operation on the voltage, the current, the speed and the acceleration of the motor of the associated stand to determine the torque of the associated stand, (b) one or more no tension torque calculation devices each associated with each of the stands except the master stand and the stand on the upstream side of all of the other stands except the master stand and each adapted to perform operation on the torque of the associated stand and the speed of the motor of the associated stand as well as the no tension torque, the no tension rolling force, the torque and the rolling force of the associated stand, and the speed of the motor of the stand on the upstream side of the stand associated with the no tension torque calculation device to determine the no tension torque of the associated stand, (c) one or more no tension torque memory devices each associated with each of the stands except the master stand, each of the no tension torque memory devices except that associated with the stand on the upstream side of all of the other stands except the master stand being adapted to store the no tension torque determined by the associated no tension torque calculation device when the leading end of the strip has passed the associated stand and has not reached the next stand, and the no tension torque memory device associated with the stand on the upstream side of all of the other stands except the master stand being adapted to receive the torque determined by the associated torque calculation device when the leading end of the strip has passed the associated stand and has not reached the next stand and to store the torque as the no tension torque, (d) one or more no tension force memory devices each associated with each of the stands except the master stand and each adapted to receive the rolling force when the leading end of the strip has passed the associated stand and has not reached the next stand and to store the rolling force as the no tension rolling force, (e) one or more target torque calculation devices each associated with each of the stands except the master stand and each adapted to perform operation on the speed of the motor of the associated stand as well as the cross sectional area, the speed and the target tension of the strip on the exit side of the associated stand to determine the target tension torque, (f) one or more speed correction calculation devices each associated with each of the stands except the master stand, each of the speed correction calculation devices except that associated with the stand on the upstream side of all of the other stands except the master stand being adapted to perform operation on the no tension torque, the no tension rolling force, the torque and the rolling force of the associated stand, and the speed of the motor of the associated stand as well as the no tension torque, the no tension rolling force, the torque and the rolling force of the stand on the upstream side of the associated stand, and the speed of the motor of the stand on the upstream side of the associated stand to determine the speed correction quantity, and the speed correction calculation device associated with the stand on the upstream side of all of the other stands except the master stand being adapted to perform operation of the no tension torque, the no tension rolling force, the torque and the rolling force of the associated stand as well as the target torque for the associated stand to determine the speed correction quantity.

* * * * *